US009619949B2

(12) United States Patent
Rood

(10) Patent No.: US 9,619,949 B2
(45) Date of Patent: Apr. 11, 2017

(54) VEHICLE OPERATOR INCENTIVE SYSTEM AND VEHICLE FLEET MANAGEMENT PLATFORM

(71) Applicant: Christopher Rood, Greenfield, IN (US)

(72) Inventor: Christopher Rood, Greenfield, IN (US)

(73) Assignee: SHEM, LLC, Hagerstown, IN (US)

( * ) Notice: Subject to any disclaimer, the term of this patent is extended or adjusted under 35 U.S.C. 154(b) by 0 days.

(21) Appl. No.: 14/875,758

(22) Filed: Oct. 6, 2015

(65) Prior Publication Data

US 2016/0098869 A1 Apr. 7, 2016

Related U.S. Application Data

(60) Provisional application No. 62/060,277, filed on Oct. 6, 2014.

(51) Int. Cl.
*G07C 5/08* (2006.01)

(52) U.S. Cl.
CPC ..... *G07C 5/0825* (2013.01); *G07C 5/0808* (2013.01); *G07C 5/0833* (2013.01)

(58) Field of Classification Search
CPC ... G07C 5/0825; G07C 5/0808; G07C 5/0833
See application file for complete search history.

(56) References Cited

U.S. PATENT DOCUMENTS

2014/0095305 A1* 4/2014 Armitage ..... G06Q 30/0251 705/14.49

* cited by examiner

*Primary Examiner* — Basil T Jos
(74) *Attorney, Agent, or Firm* — Loeb & Loeb LLP

(57) ABSTRACT

The example embodiments may relate to a vehicle operator incentive system. In an example, the system may include a vehicle control system having a plurality of controllers, wherein the controllers are configured to communicate diagnostic messages via an internal communication network and wherein each of the diagnostic messages provides information about operation of a vehicle by an operator. The vehicle operator incentive system may include a vehicle diagnostic system communicatively coupled to the internal communication network and configured to: process the diagnostic messages to determine a plurality of measured parameters, award points based on the measured parameters, calculate a score for the operator based on the awarded points, and cause a user interface of the vehicle to display the operator score.

20 Claims, 9 Drawing Sheets

Leaderboard 702

| Rank 704 | User Identifier 706 | Score 708 | Milestones Accomplished 710 |
|---|---|---|---|
| 1 | CDR | 142 | 5 |
| 2 | DMO | 119 | 4 |
| 3 | BOB | 105 | 4 |
| 4 | SLK | 51 | 2 |
| 5 | ZZZ | 0 | 0 |

Current Operator 712

| | | | |
|---|---|---|---|
| 1 | CDR | 142 | 5 |

FIG. 7

VEHICLE OPERATOR INCENTIVE SYSTEM AND VEHICLE FLEET MANAGEMENT PLATFORM

CROSS REFERENCE TO RELATED APPLICATIONS

This application claims the benefit of, and priority to, U.S. Prov. Appl. No. 62/060,277 filed Oct. 6, 2014, entitled "Vehicle Operator Incentive System And Vehicle Fleet Management Platform," the entire content of which is incorporated herein by reference.

TECHNICAL FIELD

The present disclosure generally relates to an incentive system for a vehicle operator and, in some more specific embodiments, to an onboard vehicle operator incentive system that collects and displays information from an internal communication network on a truck or other vehicle.

BACKGROUND

Trucks, such as refuse hauling trucks, and other vehicles may contain an internal communication network (e.g., a vehicle data bus), which is connected to a number of different components and systems within the vehicle and allows such components and systems to broadcast messages relating to their operations. For example, such components and systems may broadcast messages related to their function or performance, or may broadcast fault codes indicating problems or malfunctions. Information broadcast over the network may be read by various other networked components and/or used to communicate information to a user, such as by use of display gauges (speedometers, tachometers, etc.) or warning lights, or by use of a computer system connected to the network. The network may use a standardized communication standard, such as the J1939 standard, which may be used by heavy duty trucks.

SUMMARY

The following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

The example embodiments may relate to a vehicle operator incentive system. In an example, the system may include a vehicle control system having a plurality of controllers, wherein the controllers are configured to communicate diagnostic messages via an internal communication network and wherein each of the diagnostic messages provides information about operation of a vehicle by an operator. The vehicle operator incentive system may include a vehicle diagnostic system communicatively coupled to the internal communication network and is configured to: process the diagnostic messages to determine a plurality of measured parameters, award points based on the measured parameters, calculate a score for the operator based on the awarded points, and cause a user interface of the vehicle to display the operator score.

BRIEF DESCRIPTION OF THE DRAWINGS

The invention may be better understood by references to the detailed description when considered in connection with the accompanying drawings. The components in the figures are not necessarily to scale, emphasis instead being placed upon illustrating the principles of the invention. In the figures, like reference numerals designate corresponding parts throughout the different views.

To understand the present disclosure, it will now be described by way of example, with reference to the accompanying drawings in which:

FIG. 7 is a front view of a leaderboard display providing feedback to an operator according to aspects of the example embodiments.

Figure 1:
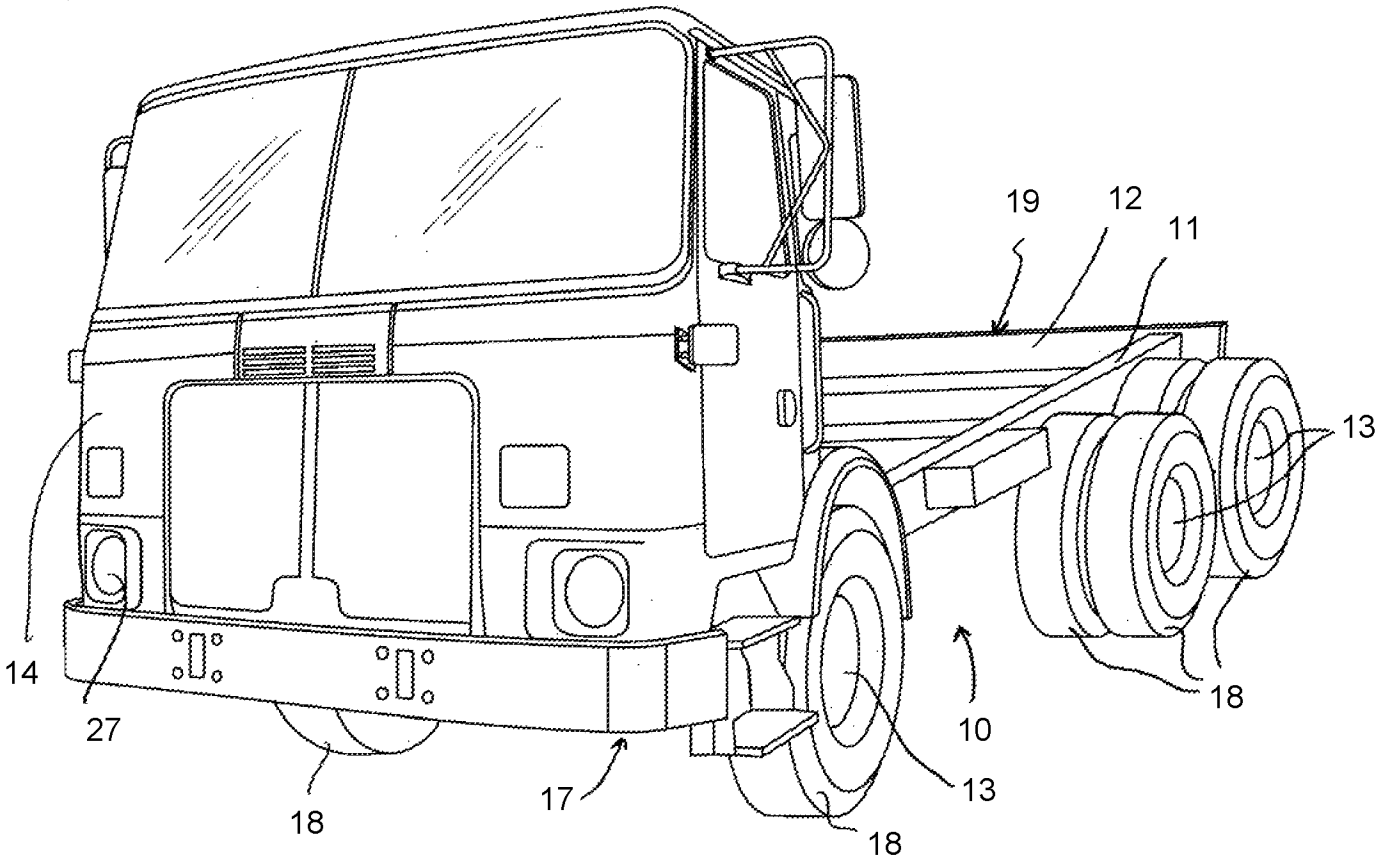
FIG. 1 is a perspective view of a vehicle according to aspects of the example embodiments.

It is understood that certain components may be removed from the drawing figures in order to provide better views of internal components.

Persons of ordinary skill in the art will appreciate that elements in the figures are illustrated for simplicity and clarity so not all connections and options have been shown to avoid obscuring the inventive aspects. For example, common but well-understood elements that are useful or necessary in a commercially feasible embodiment are not often depicted in order to facilitate a less obstructed view of these various embodiments of the present disclosure. Persons of ordinary skill will further appreciate that while certain actions and/or steps may be described or depicted in a particular order of occurrence, such specificity with respect to sequence is not required. The terms and expressions used herein are to be defined with respect to their corresponding respective areas of inquiry and study except where specific meanings have otherwise been set forth herein.

DETAILED DESCRIPTION

While the example embodiments described herein can be embodied in many different forms, there is shown in the drawings, and will herein be described in detail, embodiments of the invention with the understanding that the present disclosure is to be considered an example of the principles of the invention and is not intended to limit the broad aspect of the invention to the embodiments illustrated.

Vehicles, such as heavy-duty trucks, may be commercially used for a broad range of vocational applications. In many cases, the job at hand takes priority over efficient vehicle use, which may result in wasted fuel and excessive wear and tear on components of the vehicle. Vehicle operators often may not consider how efficiently a vehicle is being operated and may ignore vehicle warnings that can cause down time and wasted fuel. The example embodiments seek to provide an on-vehicle software system that gives cues to operators on how efficiently the vehicle is being operated and a scoring system intended to motivate efficient and safe driving habits. An operator's score may be used to reward the operator and to encourage efficient vehicle usage. An organization may use operator scores to manage a vehicle fleet, such as to forecast fuel usage, to assign operators to routes, and to manage ordering of parts for vehicle repairs, as described in further detail below.

Figure 2:
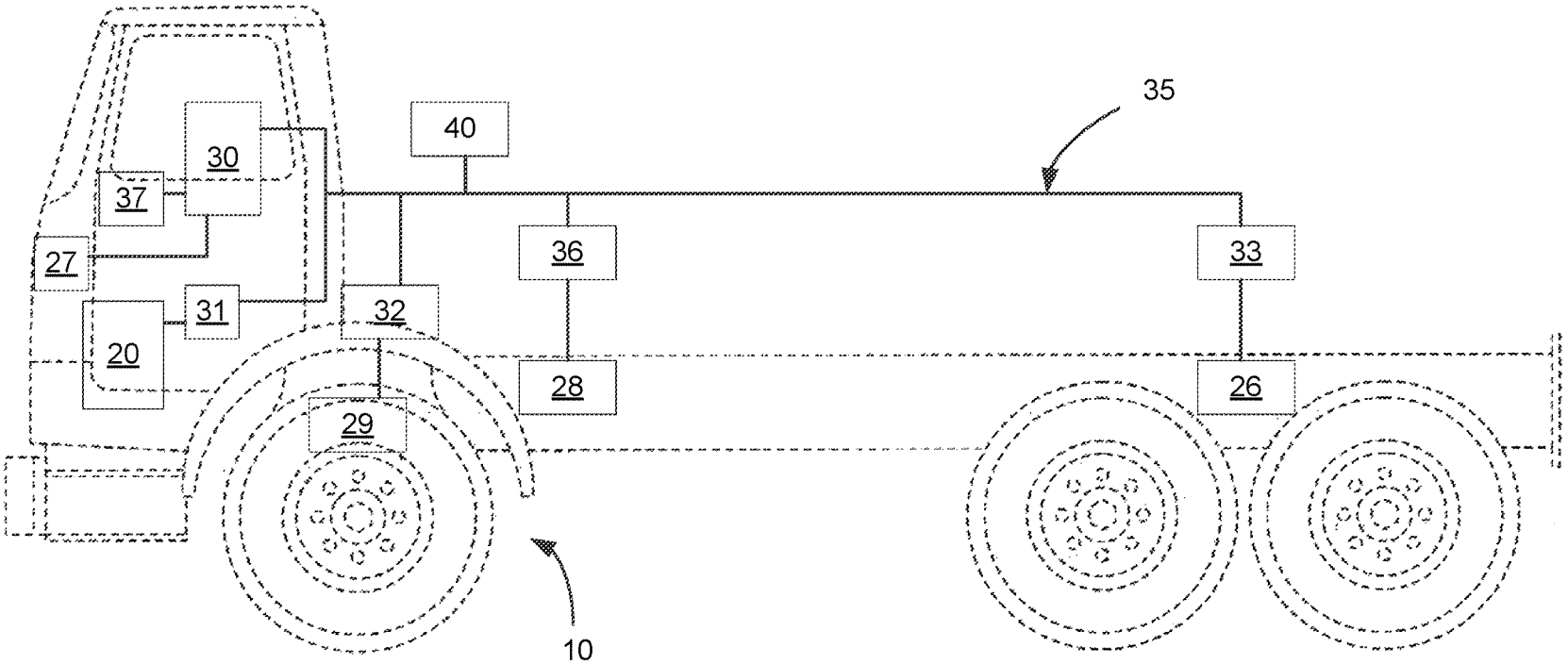
FIG. 2 is a schematic view of an internal communication network mounted to the vehicle of FIG. 1A (illustrated with dashed lines) and a vehicle diagnostic system, according to aspects of the example embodiments.

Referring now in detail to the Figures, FIGS. 1-2 illustrate a vehicle, generally designated with the reference numeral 10. In one embodiment, the vehicle is in the form of a refuse hauling truck. It is understood that aspects and features of the present invention can be incorporated into various types of vehicles including other heavy-duty vehicles, medium-duty vehicles, or light-duty vehicles of various applications.

Vehicle 10 generally includes a chassis 12 supporting an operator cab 14 and a vehicle body 16. When assembled, the body 16 and the operator cab 14 are mounted on the chassis 12. Chassis 12 is preferably a truck chassis and may have frame members or rail members 11, and the chassis 12 has a front portion 17 for supporting the operator cab 14 and a rear portion 19 for supporting the body 16. In one embodiment, the rail members 11 are made from steel and are generally rectangular in cross-section (e.g., a C-section). In one embodiment, rail members 11 extend substantially the entire length of the chassis 12, and may serve as points of support and/or connection for the body 16, the cab 14, the axles 13, and other components. As is known in the art, the chassis 12 has a front axle 13 and one or more rear axles 13 which in turn are attached to wheels 18 for movement of the chassis 12 along a surface. Additionally, as shown in FIGS. 1-2, the vehicle 10 includes a drivetrain that includes an engine 20 connected to a transmission 29 (both shown schematically) configured to transfer power to at least one of the wheels 18. The transmission 29 may be connected to one or both rear wheels 18 in one embodiment, but it is understood that the transmission may be connected to transfer power directly to any number of the wheels 18, including, additionally or alternately, one or more of the front wheels 18 in some embodiments. It is understood that the transmission 29 may allow shifting between several settings (e.g., D, N, R) and several gears (e.g., various forward-drive gear ratios). Additional components connected to the engine 20 may be included as well, including an exhaust pipe, an air cleaner assembly, etc. Vehicle 10 may further include components such as a brake system 26, e.g., an anti-lock brake system (ABS), which is connected to the wheels 18 and configured to slow and stop the vehicle 10 from rolling, as well as a light system 27, which may include various lights and turn signals.

Figure 1A:
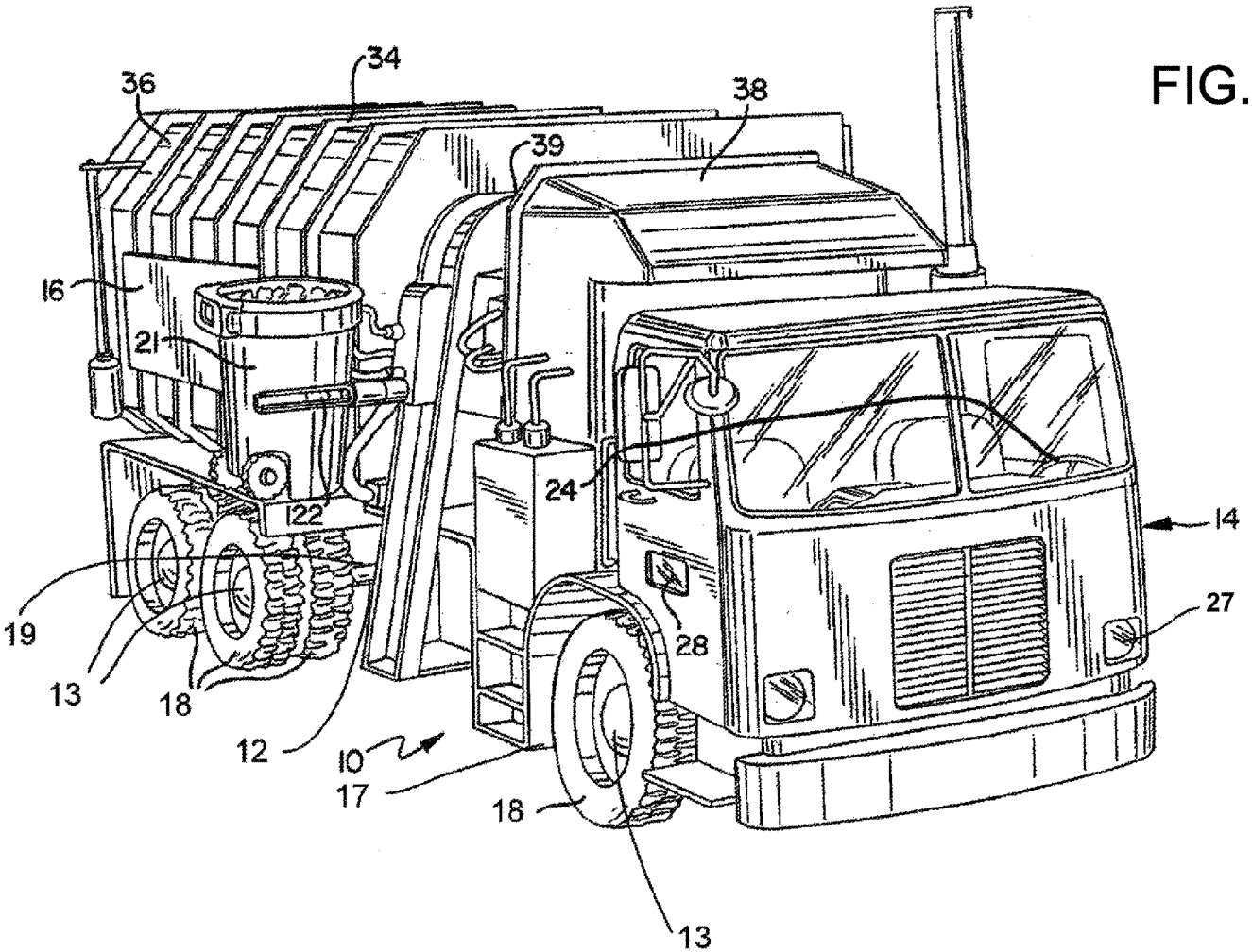
FIG. 1A is a perspective view of the vehicle of FIG. 1 with a body connected to the vehicle, in the form of a refuse truck.

The chassis 12 may receive several different configurations of the body 16, having various functionalities. As illustrated in FIG. 1A, in an example embodiment for a refuse truck, the body 16 includes a storage area 34, a loading area (not shown), a reception area 38, an open hopper 39 and a moveable arm 122. Refuse 21 may be loaded in the reception area 38 by use of the arm 122. Refuse is stored in the storage area 34 and generally compacted within the body 16. However, as understood by those of skill in the art, other bodies for different purposes such as front loaders, rear loaders, dump trucks, straight trucks, cement trucks, pumpers, sweepers, and other applications may be used in connection with the present disclosure. Numerous components of the body 16 are capable of being adjusted, manipulated, or otherwise actuated such as lifting the axles, manipulating the arm 122, opening the hopper 39, and compacting.

Figure 4:
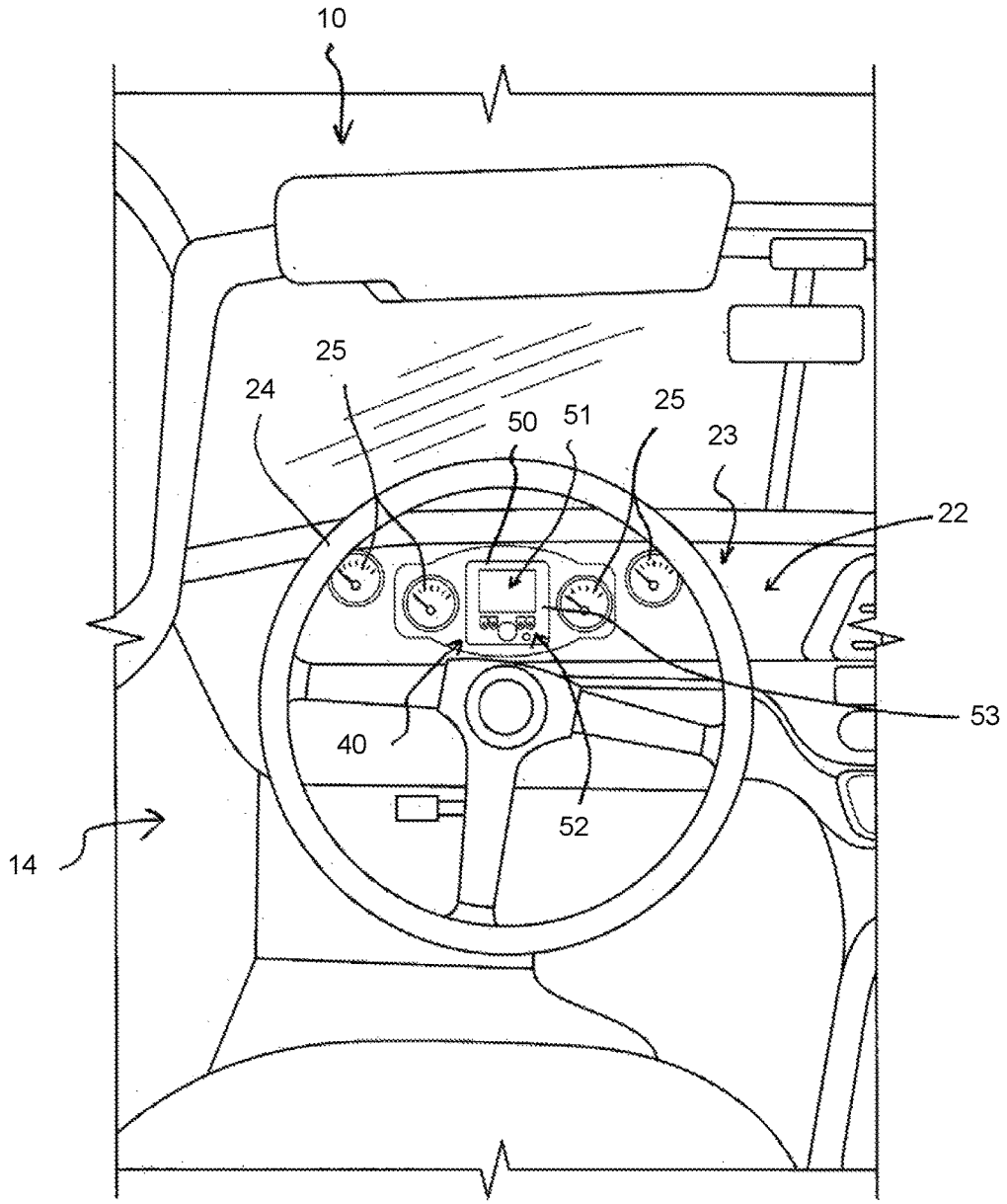
FIG. 4 is a prospective, sectional view of an operator area of the vehicle, showing the display and the dashboard of FIG. 3.

The operator cab 14 generally includes passenger area, which in the embodiment of FIGS. 1-2, and 4, includes both a left area and a right area. The vehicle 10 may be operable in a left and/or right hand drive configuration, and may be switchable between such configurations, and the left and right areas may be configured for one or more operators or passengers, depending on the drive configuration. The operator cab 14 may also include controls (not shown) for operating and monitoring the vehicle 10, some of which may be located on a dashboard 23, such as a steering wheel 24 in addition to various switches and interfaces (e.g., graphical user interfaces), etc., including for example an ignition switch, and a transmission control (e.g., a stick or a push-button control), which may be located on or in the dashboard 23 and/or a console separating the left and right areas of the cab 14. Controls may further include actuators for a main or service braking system, which may be air brakes in one embodiment, a parking brake system, or a throttle (e.g., an accelerator), as well as controls for lifting the axles, manipulating the arm 122, opening the hopper 39, compacting, etc. At least some of such controls may be integrated into and/or controlled by a vehicle control system, as described herein. Although not necessarily a control, the dashboard 23 or other suitable component of the vehicle 10 may include various gauges/meters 25.

The vehicle 10 generally includes a vehicle control system, which includes a primary vehicle controller 30, as well as various controllers configured for controlling specific components of the vehicle 10. For example, in the embodiment of FIG. 2, the vehicle control system may include an engine controller 31 configured to control the engine 20, a transmission controller 32 configured to control the transmission 29, and a brake controller 33 configured to control the brake system 26 of the vehicle 10. In other embodiments, the control system may include additional or alternate controllers that are configured to control other components of the vehicle. For example, if the vehicle has a compressed natural gas (CNG) fuel system 28, the vehicle 10 may also include a fuel controller 36 to control the fuel system 28, as illustrated in FIG. 2. Additionally, the control system may include other controllers, such as body controls, a GPS data monitoring system, etc. The vehicle 10 may also include an internal communication network 35 that is generally in communication with the various components of the vehicle control system, including the various controllers 30, 31, 32, 33, 36, allowing the components of the control system to communicate with each other and with other systems via the network 35. The network 35 may be a J1939 databus network in one embodiment, and may be configured for wired and/or wireless data communication. The vehicle control system may also be connected to various instrumentation 37 (e.g., the gauges 25), at least some of which may be visible and/or accessible from within the operator cab 14 for communicating information to the user, such as information regarding the operation of various vehicle systems and components. The vehicle control system may further include a secondary vehicle controller (not shown) in one embodiment, which may be configured with its own logic structure, but may report directly to the primary vehicle controller 30 rather than to the network 35 and/or may be controlled by the primary controller 30 reporting directly onto the primary vehicle databus. It is understood that the secondary vehicle controller may be considered to be an extension of the primary vehicle controller 30 in some embodiments.

Figure 5:
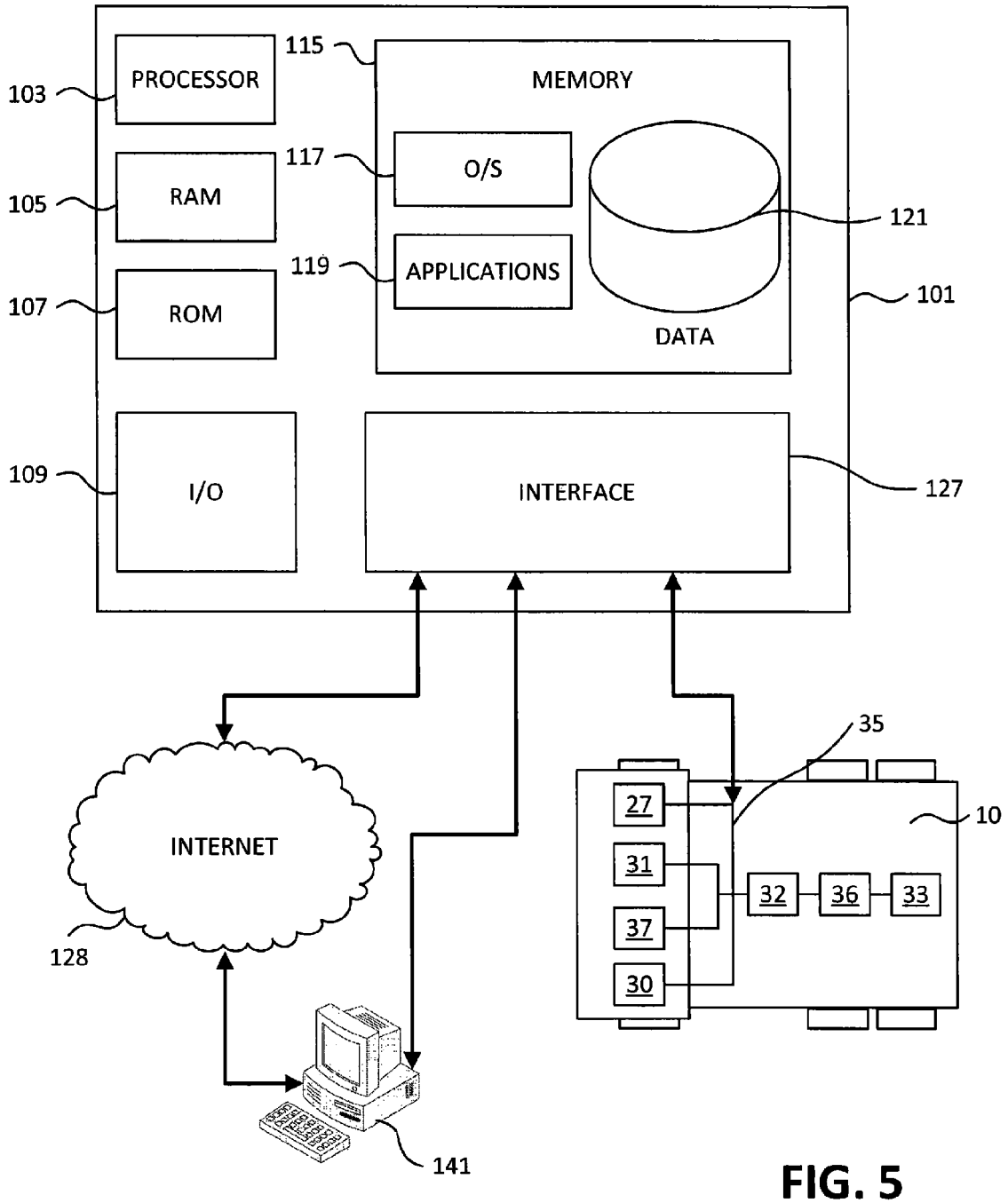
FIG. 5 is a schematic diagram showing one embodiment of a vehicle operator incentive system according to aspects of the example embodiments.

In one embodiment, vehicle 10 includes a vehicle diagnostic system 40 that is connected to the network 35 and configured for communication with the various controllers 30, 31, 32, 33 of the vehicle control system. FIG. 5 illustrates a block diagram of a computer device or computer system 101 as an exemplary diagnostic system 40. As will be appreciated by one of skill in the art upon reading the following disclosure, various aspects described herein may be embodied as a method, a data processing system, or a computer program product. Accordingly, those aspects may take the form of an entirely hardware embodiment, an entirely software embodiment or an embodiment combining software and hardware aspects. Furthermore, such aspects may take the form of a computer program product stored by one or more tangible and/or non-transitory computer-readable storage media having computer-readable program code, or instructions, embodied in or on the storage media. Any suitable tangible and/or non-transitory computer readable storage media may be utilized, including hard disks, CD-ROMs, optical storage devices, magnetic storage devices, and/or any combination thereof. In addition, various intangible signals representing data or events as described herein may be transferred between a source and a destination in the form of electromagnetic waves traveling through signal-conducting media such as conductive (e.g., metal) wires, optical fibers, and/or wireless transmission media (e.g., air and/or space).

Figure 3:
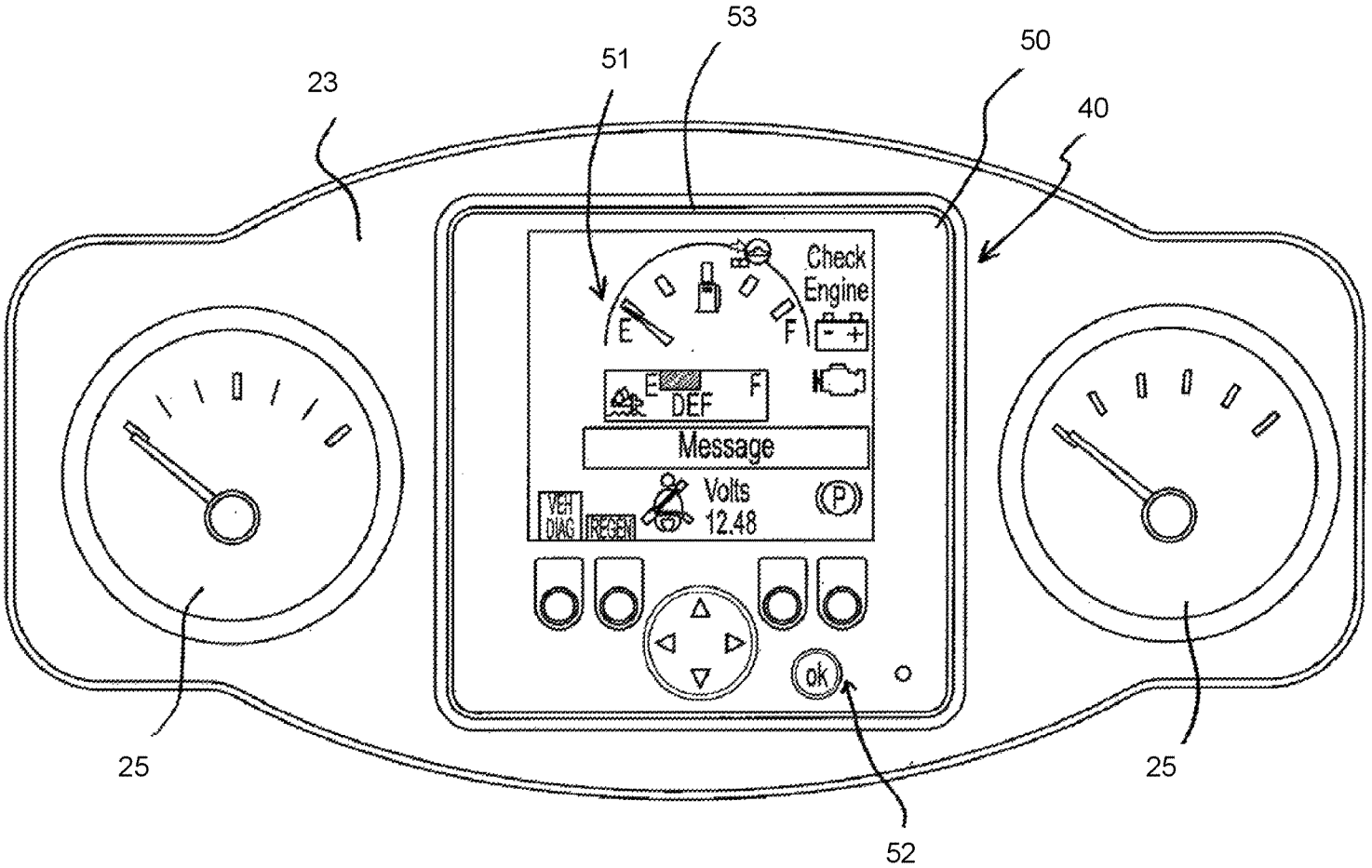
FIG. 3 is a front view of a display of a vehicle diagnostic system according to aspects of the example embodiments, mounted within a dashboard of a vehicle.

The computer system 101 may have a processor 103 for controlling overall operation of the computer system 101 and its associated components, including RAM 105, ROM 107, input/output module 109, and memory 115. I/O 109 may include a user input device through which a user of computer system 101 may provide input, such as a microphone, keypad, touch screen, other types of buttons, mouse, and/or stylus, and may also include one or more speakers for providing audio output and a video display device for providing textual, audiovisual and/or graphical output. The I/O 109 may also include equipment for collecting other forms of information or input, such as a device for collecting biometric input and/or audio input, a barcode reader or other device for collecting graphic input, or other type of input device. In at least one embodiment, the I/O may be at least partially embodied by a dashboard user interface 50 that provides both input and output interfaces for the user, as illustrated in FIGS. 3-4 and described in greater detail herein.

Software may be stored within memory 115 and/or other storage to provide instructions to processor 103 for enabling the computer system 101 to perform various functions, including functions relating to the methods described herein. For example, memory 115 may store software used by the computer system 101, such as an operating system 117, application programs 119, and an associated database 121. Alternatively, some or all of the computer executable instructions may be embodied in hardware or firmware (not shown). The software database 121 may provide centralized storage of vehicle information. It is understood that the memory 115 may store vehicle information that is not in database format, and that the memory 115 may include temporary and/or permanent memory. It is also understood that a computer system 101, single processor 103, and single memory 115 are shown and described for sake of simplicity, and that the computer system 101, processor 103, and memory 115 may include a plurality of computer devices or systems, processors, and memories respectively, and may comprise a system of computer devices, processors, and/or memories.

The computer system 101 may be configured to operate in a networked environment supporting connections to one or more other computing devices 141. Such other computing devices 141 may include any of the components and features of the computer system 101 described herein and illustrated in FIG. 5, as well as other features. The other computing devices 141 may be any suitable type of computer device, such as one or more personal computers, servers, mobile devices, and any other conceivable type of computer component or device, that include many or all of the elements described above relative to the computer system 101. The device 101 may be operably coupled to various network connections for connection to the other devices 141, such as a wide area network (WAN), a local area network (LAN), a cellular/mobile network, and other communication paths. One or more communications interfaces 127 generally provide connections to these various networks. When used in a LAN networking environment, the computer system 101 is connected to the LAN through a network interface or adapter. When used in a WAN networking environment, the computer system 101 may include a modem for establishing communications over the WAN, and may also include transceivers for Wi-Fi, Bluetooth, infrared or other optical communication, near field communication (NFC), among other means. Connection to a cellular/mobile network may be provided, for example, by a GSM/TDMA service provider. The other communication paths mentioned can include direct communication, such as by Bluetooth or Wi-Fi. Use of a WAN can provide connection to the Internet 128, and it is understood that other communication paths, such as cellular/mobile network can also provide Internet connectivity. It is understood that the computer system 101 can connect to one or more of the other devices 141 through more than one of such networks. It will be appreciated that the network connections shown are exemplary and other means of establishing a communications link between the computers may be used. The existence of any of various well-known protocols is presumed. Additionally, an application program 119 used by the computer system 101 according to an illustrative embodiment may include computer executable instructions for invoking user functionality related to various communication techniques.

The computer system 101 may be configured for communication with the vehicle control system through the interface 127 as well. As shown in FIG. 5, the computer system 101 is configured for communication with various vehicle components, including the various controllers 30, 31, 32, 33, 36 of the vehicle control system, as well as the light system 27 and the vehicle instrumentation 37. It is understood that the computer system 101 may be in communication with additional components and/or may not communicate with some of the illustrated components, in further embodiments.

As described above, aspects of the systems and methods described herein may be described in the general context of computer-executable instructions, such as program modules, being executed by a computer. Generally, program modules include routines, programs, objects, components, data structures, and the like, that perform particular tasks or implement particular abstract data types. Such a program module may be contained in a tangible and/or non-transitory computer-readable medium, as described above. The systems and methods described herein may also be practiced in distributed computing environments where tasks are performed by remote processing devices that are linked through a communications network. In a distributed computing environment, program modules may be located in the memory 115, which may include both local and remote computer storage media including memory storage devices. It is understood that connections and communications disclosed herein may be made by any type of wired or wireless connection or communication.

In one embodiment, the vehicle diagnostic system 40 is configured to operate by monitoring all messages on the network 35, but may be programmed only to take action on specific messages from specific controllers or other components that contain information pertinent to desired functionality. Vehicle information of desired types that is collected from the network 35 by the diagnostic system 40 are stored into either temporary or permanent memory 115, depending on circumstances, such as functional requirements, the nature of the information, etc. For example, information such as vehicle speed is recorded into temporary memory due to the nature of the information, as it is frequently changing and dismissive when the vehicle is not running. As another example, information on vehicle hours and distance travelled over a certain amount of time may be stored into permanent memory and accessed as desired. In an embodiment where the primary vehicle controller 30 has a subservient secondary vehicle controller, the diagnostic system may receive information on the secondary vehicle controller via messages from the primary vehicle controller 30. In one embodiment, the diagnostic system 40 may not include any specialized or dedicated inputs or outputs for communication with other components of the vehicle 10, and may receive and transmit all information from and to other vehicle components through a single connection to the network 35.

Additionally, many of the components of the vehicle control system may send out the same messages (e.g., via SAE defined headers) at times. In this situation, the diagnostic system 40 may be configured to filter out the message from the most pertinent source of information for the data that is required and to ignore similar messages from other components.

The diagnostic system 40 is also configured to broadcast messages over the network 35, to interface with the other components on the network 35. For example, the diagnostic system 40 may broadcast a request for information from one or more other components on the network 35 that is not normally broadcast from such component(s). As another example, the diagnostic system may broadcast control messages to one or more other components on the network 35, such as a request for manual diesel particulate filter (DPF) regeneration. As a further example, the diagnostic system 40 may broadcast one or more proprietary messages to the primary vehicle controller 30 to relay command information on the forcing on of outputs. Such outputs may include outputs that are controlled by the primary vehicle controller 30 and/or the secondary vehicle controller, if present. Examples of such outputs include, without limitation, lighting controls, lift axle controls, neutral and reverse power outputs, and starter solenoid power, among others. These transmissions of the diagnostic system 40 may be initiated manually, such as via a button on the user input 52, or automatically, or a combination of such techniques.

The diagnostic system 40 may include a user interface 50 that is located within the operator cab 14 and is configured for transmitting information to the user and receiving input from the user. The user interface 50 may include a display screen that is touch-sensitive or may include dials, buttons, and the like for displaying information to the operator and for receiving operator input. One embodiment of the user interface 50 is illustrated in FIGS. 3-4, and is in the form of a module 53 located on or in the dashboard 23 of the vehicle 10. It is understood that the module 53 may be located elsewhere in other embodiments, such as within a console within the operator cab 14, and that the module 53 may be connected to portions of the vehicle 10 such as by embedding within various components (e.g., the dashboard as shown in FIGS. 3-4), mounting on top of various components, etc. The user interface 50 includes a display 51 that is configured to provide a visual display for the user, and a user input 52 that is configured to receive input from the user. The display 51 includes a video display in the embodiment illustrated in FIGS. 3-4, and may also include audio output for generating audio signals, such as alarms, indications of confirmation, etc. The user input 52 includes several tactile buttons in the embodiment illustrated in FIGS. 3-4, and may additionally or alternately include other input, such as a touch screen or speech recognition/voice control that responds to a user's spoken commands. The user interface 50 may include further components for user interaction in further embodiments. Additionally, the module 53 for the user interface 50 may include some or all of the computer components of the diagnostic system 40, such as the memory 115, the processor 103, the interface 127, etc., illustrated in FIG. 5, and the module 53 may perform some or all of the actions and methods described herein with respect to the diagnostic system 40. In one embodiment, the user interface 50 provides all of the functionality of the diagnostic system 40 within the module 53. It is understood that some of the components of the computer system 101 may be located elsewhere in certain embodiments.

In some examples, the vehicle 10 may provide feedback to an operator to encourage safe and efficient usage of the vehicle. To provide this feedback, the vehicle diagnostic system 40 may monitor diagnostic messages communicated via the internal communication network 35 from various components, including controllers 31, 32, 33, and 36, while the operator drives the vehicle. The vehicle diagnostic system 40 may extract vehicle parameters from the diagnostic messages that indicate how the vehicle is currently being operated, and may calculate an operator score based on the vehicle parameters. The operator score may be a numeric assessment indicating how fuel efficiently and safely the operator is operating the vehicle. The vehicle diagnostic system 40 may communicate the operator score to the user interface 50 for presentation to the operator via display 51. Display 51 may visually alert the operator of progress made towards efficiency, productivity and safety goals.

Figure 6:
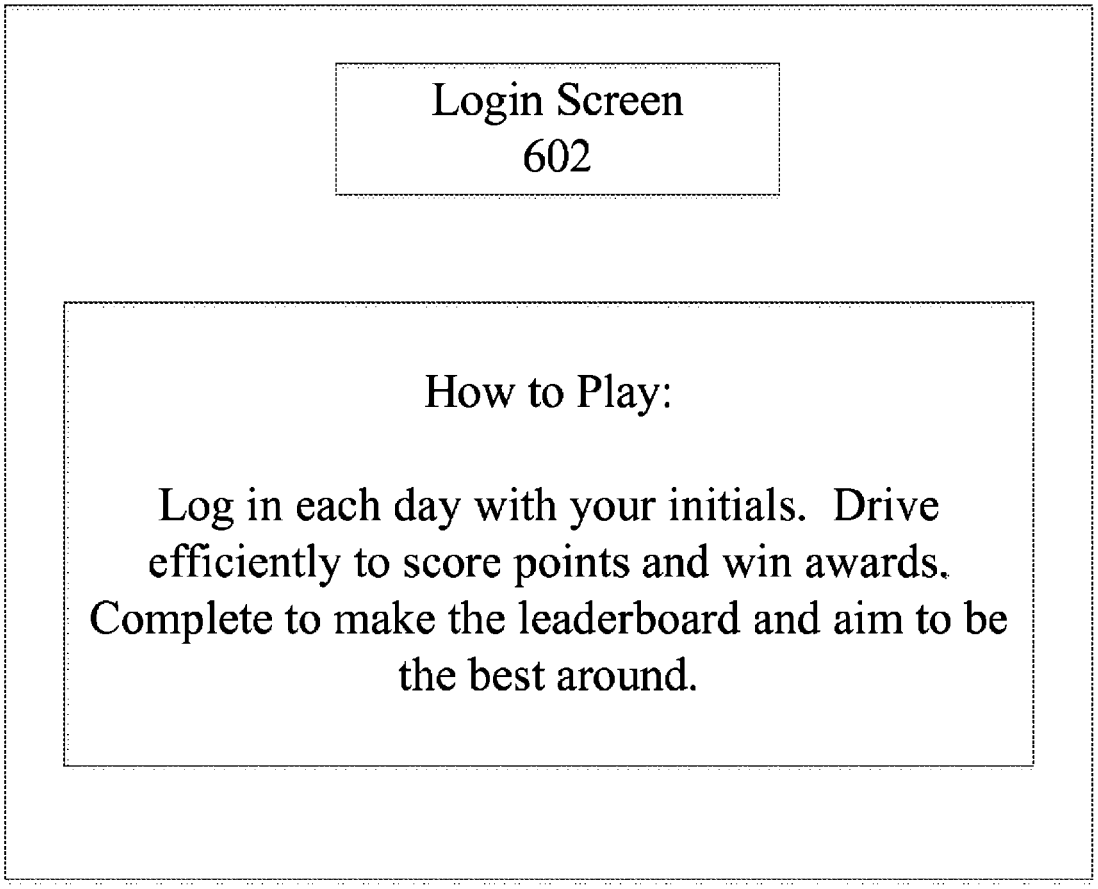
FIG. 6 is a front view of a login display prompting an operator to login to a vehicle operator incentive system according to aspects of the example embodiments.

When an operator enters and turns the vehicle on, the user interface 50 may prompt the operator to enter a user identifier to uniquely identify the operator. The identifier may constitute, for example, the operator's name, operator's initials, employee number, username and password, and/or any other information that may be used to distinguish the operator from other operators. FIG. 6, for example, depicts a login screen 602 in display 51 prompting the operator to log in by entering their initials. The vehicle diagnostic system 40 optionally may process the information input by the operator in an attempt to authenticate the operator. Once logged in, the system 40 may store vehicle operation parameters in association with the entered user identifier.

During vehicle operation, the vehicle diagnostic system 40 may monitor diagnostic messages communicated on the vehicle databus to obtain parameters on how the vehicle is currently being operated. Vehicle diagnostic system 40 may process the monitored parameters to generate an operator score that provides feedback to the operator. The operator score may be a numerical value and may be used to encourage one or more of safe vehicle operation, fuel conservation or other cost savings, reduced vehicle wear and tear, and efficient vehicle usage. Vehicle diagnostic system 40 may apply an algorithm to generate a number of points based on each measured parameter, and the operator score may be a function of the points. The following table provides a non-exhaustive list of example vehicle parameters that may be measured during vehicle operation, the types of diagnostic messages being monitored, the associated algorithm for calculating points, and the benefit resulting from encouraging a particular operator behavior.

TABLE 1

| Measured Parameter | What is used to Measured | Algorithm | Benefit |
|---|---|---|---|
| Seatbelt Usage | Input from seatbelt switch signal; J1939 message for vehicle speed | Monitor seatbelt while vehicle is in motion. Award a predetermined number of points if seatbelt is buckled. Deduct points whenever vehicle speed is greater than 10 mph and seatbelt is not buckled. If points are deducted and the seatbelt is later fastened while driving, points are re-awarded after a certain duration. | Driver Safety |
| Cruise Control | J1939 messages for vehicle speed and cruise control status | Award a predetermined number of points if used cruise control on route for more than a predetermined amount of time (e.g., 30 minutes). | Fuel savings. More efficient fuel consumption while using cruise control |
| Distance Travelled | J1939 message for trip distance | Award a predetermined number of points for travelling a predetermined distance during a day (e.g., 100 miles). | Motivation. Encourage operator to travel assigned route. |
| Power Take-Off (PTO) Usage | J1939 messages for PTO usage | Award a predetermined number of points for using the PTO to perform job duties a predetermined number of times in a day (e.g., 30 times). | Motivation./ Encourage operator to properly use vehicle tools |
| Reverse | J1939 messages for gear shift information | Award a predetermined number of points for shifting the vehicle into reverse shifts less than a predetermined number of time per day (e.g., 10 or under). | Efficiency. Encourage drivers to not overshoot stops and waste time and fuel |
| Regen (Diesels only) | J1939 messages for soot load information | Award a predetermined number of points for keeping the soot level of the vehicle under a predetermined number (e.g., 120%). | Maintenance/Cost Savings. Encourage proper maintenance of the vehicle and save potential costs of replacing the very expensive filter if not properly maintained. |
| Acceleration Rate | J1939 messages for throttle position and vehicle speed | Determine the rate of acceleration. For example, on actuation of the accelerator pedal, monitor change in vehicle speed over at least one 5 second time period, take the standard difference of the speeds, and create a coefficient of variance to determine acceleration rate. Award a predetermined number of points for keeping the coefficient within a predetermine amount of a desired acceleration rate. | Fuel/Cost Savings. Save cost by saving fuel, as a result of more efficient accelerations and not mashing the pedal |
| Braking Aggressiveness | J1939 messages for service brake application and vehicle speed | Monitor how aggressively the vehicle is braking based on deceleration rate. On actuation of the brake, record change in vehicle speed over at least one 5 second time period, calculate the standard difference of the speeds, and create a coefficient of variance to determine deceleration rate. Award a predetermined number of points for keeping the coefficient within a predetermine amount of a desired deceleration rate. | Cost savings. Save cost by extending the life of the brakes as well as fuel savings by not using as much fuel to get going again. |

TABLE 1-continued

| Measured Parameter | What is used to Measured | Algorithm | Benefit |
|---|---|---|---|
| Fuel Economy | J1939 messages for distance and fuel usage | Upon starting the game, reset trip counter and calculate fuel economy by dividing the difference in miles over the difference in fuel usage. Award a predetermined amount of points for having fuel economy at or above at least a certain number (e.g., at or above 15 miles per gallon) | Cost savings. Save cost on fuel by encouraging overall economic fuel usage. |
| No engine errors | J1939 information for active engine errors | Monitor status of engine errors. Award a predetermine amount of points for not driving with the error light active. Deduct points if error stays active for more than a predetermined amount of time (e.g., a half hour). | Maintenance. Keep the vehicle properly maintained. Results in cost savings by less part failures, making sure errors are clear and vehicle is not driven for an extended period of time with errors that can result in bigger problems if not taken care of. |
| Idle Fuel Usage | J1939 information for fuel usage and idle status | Record the amount of fuel burned wastefully while idling. Awards points for keeping idle fuel usage amount below a predetermined value | Cost savings/Efficiency. Waste less fuel with the vehicle idling. |

Vehicle diagnostic system 40 may calculate how many points to award the operator based on current values for the measured vehicle parameters using the algorithms specified in Table 1. Vehicle diagnostic system 40 may calculate an operator score based on a mathematical function of the awarded points and display the result in the user interface 50. In an example, the mathematical function may be simple addition of the points awarded for each of the measured parameters. In another example, vehicle diagnostic system 40 may weigh the points awarded to certain vehicle parameters relative to others to encourage the associated operator behavior. For example, when fuel costs are high, a greater number of points may be awarded for fuel economy and lack of idle fuel usage. Vehicle diagnostic system 40 may calculate the operator score in substantially real-time, at predetermined time periods, or only when the operator has completed his or her route.

The user interface 50 may present a menu screen that can be accessed to review the current operator's performance and compare that performance to other operators (preferably when vehicle 10 is stationary). FIG. 7, for example, depicts a leaderboard display 702 displaying the user's current performance and performance relative to other operators. The leaderboard display 702 may include data 712 on the current operator's performance data including current score value and awards obtained. The leaderboard display 702 may also display a summary of driver statistics related to his or her performance data in relation to the measured parameters. The leaderboard display 702 may contain a ranking system comparing operator performances via scores achieved to indicate the top scoring operators (e.g., top 5 scoring operators) as motivation for the target score required to be the best performing operator. FIG. 7, for example, illustrates a leaderboard display 702 displaying a grid with a rank column 704 listing operators having the highest scores (e.g., top five), a user identifier column 706 listing user identifiers of the operators having the highest scores, a score column 708 listing scores of the operators score, and a milestones accomplished column 710 listing a number of milestones each operator has accomplished (described in further detail below). The leaderboard display 702 may also provide instructions on what performance data (e.g., fuel efficiency, braking aggressiveness, idle fuel usage, etc.) the operator should attempt to maximize to improve his or her operator score.

In some examples, vehicle diagnostics system 40 may only monitor some of the parameters from Table 1, and may select a subset of the parameters based on information received by, for example, an external source. For instance, the vehicle diagnostics system 40 may be connected to a transmitter (e.g., cellular transmitter, Wi-Fi transmitter, wired or wireless network interface, etc.) that is capable of transmitting any and all data off of the vehicle to another computing device (e.g., a computing device 141 or a server). In an example, vehicle diagnostics system 40 may communicate (e.g., wirelessly via a cellular network) with computing device 141 via a network (e.g., WAN or LAN) that instructs system 40 which of the parameters to use for generating the operator score.

Selecting which parameters to monitor may depend on the type of vehicle. For example, refuse vehicles are very different from passenger cars or even other heavy duty applications that are primarily run over the road. In the refuse industry improving fuel usage and miles per gallon can result in much greater savings as compared to passenger cars. Braking aggressiveness and rates of acceleration are also on a different scale and much more prominent in the refuse vehicles. Due to the frequency of hard acceleration and braking, even a minimal change in operator behavior can provide a large effect on fuel efficiency and brake life expectancy. Computing device 141 may send instructions to system 40 to adjust parameters and algorithms for awarding points. For instance, when fuel prices are high, computing device 141 may increase the points awarded for fuel efficiency. System parameters, algorithms and schedules (e.g., how frequently data is pulled/monitored from a vehicle) for monitoring and/or adjusting system parameters and/or algorithms can be adjusted for different vehicle vocations (e.g., street sweepers, cement trucks, front loaders, rear loaders, dump trucks, straight trucks, pumpers, etc.) dependent on the particular needs of the operator/business and vocation. Parameters may also be adjusted on-the-fly and/or fluctuate in real time (e.g., assigning fuel economy parameters a higher weight if fuel prices are above a threshold). In some examples, some or all parameters might not have a schedule of when they are pulled/monitored, and instead may only be pulled/monitored upon request. Other or all parameters may be pulled/monitored on a predetermined schedule. The predetermined schedule may be unique for each parameter defining particular instances in time when a parameter is to be pulled/monitored, or two or more parameters may be pulled/monitored at the same time instances. Some or all parameters (e.g., fuel usage parameters) may be pulled more frequently to be more real-time accurate if desired, and others may be pulled less frequently or only upon request.

In some examples, some of the parameters in Table 1 may only be monitored in certain industrial applications. Power Take-Off (PTO), for instance, is a parameter that is typically only monitored in certain industrial applications, such as in refuse vehicles. Power Take-Off (PTO) applications occur when a vehicle compresses trash or in some cases when the trash is picked up (e.g., automated side loader or front loader). The number of PTO applications indicates how much work was done on the route and may not apply in standard, non work truck applications. In a non-industrial setting, system 40 may not monitor the number of PTO applications.

The idle fuel usage parameter in Table 1 may be used for all types of vehicles, but can be tailored to the refuse industry. Although all vehicles idle and burn fuel when idling, fuel usage may be a significant consideration in the refuse industry due to its impact on business expenditure and budgeting. Warming up a refuse vehicle in the morning, frequent stopping, stepping out to pick up trash, leaving the vehicle running while at transfer stations are a few examples where the refuse vehicle can idle for potentially long periods of time and potentially waste a large amount of fuel. By adjusting the number of points an operator can earn for this parameter, the example embodiments described herein seek to align the goals of the fuel purchaser with the goals of the vehicle operator, who is typically not directly responsible for purchasing fuel and may be less concerned about how much fuel is wasted while idling. The goal alignment may be accomplished via the operator score, which fluctuates based on how much fuel was wasted during idling. Further, user interface 50 may inform the operator that additional points may be earned for fuel efficiency when fuel prices are increasing or expected to increase.

Figure 8:
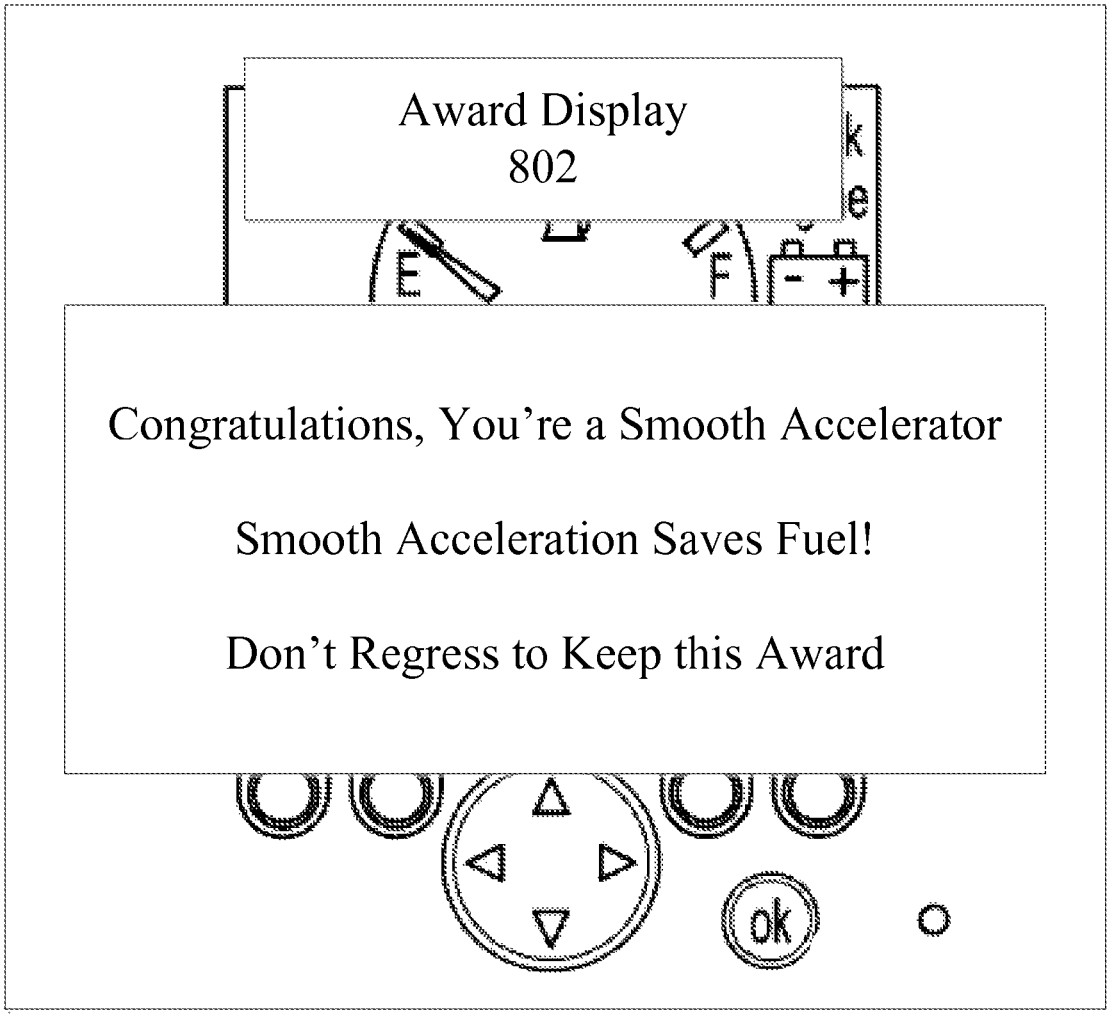
FIG. 8 is a front view of an award display according to aspects of the example embodiments.

System 40 may calculate whether the operator has met one or more predetermined milestones to earn an award. A milestone may serve as a baseline for proper vehicle performance and may be created to encourage any vehicle behavior. For example, milestones may correspond to a pattern of non-aggressive vehicle acceleration or non-aggressive vehicle braking. When a milestone is met, system 40 may trigger an accomplishment alert and the operator may be given a visual and/or audible cue (e.g., short message presented on user interface 50) that a milestone has been attained. When the system 40 determines, for example, that the vehicle has comes to a stop and that all vehicle activity is idle, user interface 50 may present a short message describing the accomplished milestone and informing the operator how to continue improving upon that accomplishment. In FIG. 8, for example, an award window 802 of the user interface 50 displays a message informing the operator that he or she has achieved an award for being a "smooth accelerator."

If, however, system 40 determines that the operator is improperly, unsafely, or inefficiently operating the vehicle, system 40 may cause the user interface 50 to present negative alerts to the operator. To do so, system 40 may determine that at least one measured parameter falls outside of an acceptable range or the operator score is below a minimum threshold. For example, system 40 may determine whether a measured acceleration parameter falls within an acceptable range, and determine that the operator is improperly, unsafely, or inefficiently operating the vehicle if the measured acceleration parameter is outside of the acceptable range. In another example, system 40 may determine that an operator score does not comply with a minimum acceptable score (e.g., falls below a minimum threshold), and cause the user interface 50 to present negative alerts to the operator. When system 40 detects improper, unsafe, or inefficient vehicle operation, system 40 may cause user interface 50 to present a visual and/or audible cue that the vehicle is being operated in a manner that is improper, unsafe or inefficient. The cue may also instruct the operator to pull over the vehicle to receive further instruction on proper vehicle operation. Vehicle diagnostics system 40 optionally may remove any previously attained awards and operator scores related to those awards when negative performance milestones for those specific parameters are reached. The operator, however, may earn the accomplishments back if operational performance improves again.

In some instances, informing management about inefficient or unsafe driving may be time-sensitive. In an example, the vehicle operator system 40 may notify the operator's manager (or other management personnel) in response to detecting that an operator is operating a vehicle in a particular manner (e.g., does not comply with acceptable standards, unsafe driving, poor or dangerous driving, etc.). The vehicle 10 may include a transmitter (e.g., cellular transmitter, Wi-Fi transmitter, wired or wireless network interface, etc.) that is capable of transmitting any and all data off of the vehicle to another computing device (e.g., a computing device 141 or a server) via a network (e.g., WAN, LAN, cellular network, etc.). The system 40 may determine to send an alert, for example, when at least one measured parameter falls outside of an acceptable range or the operator score is below a minimum threshold. An alert message may include an urgency indicator to inform a manager of how unsafe, inefficiently, etc., a vehicle is being operated. In response to detecting the substandard measured parameter or the substandard operator score, the vehicle operator system 40 may utilize a transmitter to send an alert message. In some instances, the transmitter may be in a sleep mode to conserve power and the system 40 may communicate a wake signal to activate the transmitter (e.g., transition from the sleep mode to an active transmitting state). The vehicle diagnostics system 40 may cause the transmitter to send the alert message via the network, for example, to the computing device 141. In some instances, the computing device 141 may be in a sleep mode and receiving the alert message may activate the device 141. For example, software of the device 141 may activate the device 141 in response to receiving the alert message. The software may also cause a display of the device 141 to display the alert message and may cause establishment of a network connection with the vehicle 10 or other data source for receiving additional information about operation of the vehicle.

In some examples, vehicle diagnostics system 40 may store the calculated operator score and/or some or all of the vehicle parameters in at least one of temporary and permanent memory. System 40 may be powered such that when ignition power to the vehicle 10 is removed, the vehicle diagnostics system 40 also powers down. When powering down, system 40 may prompt the operator whether to continue the analysis or to reset all data and start over as a new operator. System 40 may limit the amount of time that an operator can continue running one performance analysis to keep performance data consistent among all operators.

Vehicle diagnostics system 40 may communicate data on a particular operator to another PC and/or smart phone based application in which operators can have their own unique profiles and monitor their driving statistics, which has its own system of awards and accomplishment tracking software.

Additionally, processing of the vehicle parameters, calculating of an operator score, and other data processing, may be performed by the vehicle diagnostics system 40, by another computing device located on the vehicle 10, or by a computer or computing device external to the vehicle 10, such as by computing device 141. For example, vehicle diagnostics system 40 may communicate raw vehicle operation data via a network (e.g., LAN, WAN, cellular network, etc.) to computing device 141. In such a scenario, computing device 141 may communicate instructions to the user interface 50 via a communication network (e.g., local area network, cellular network, Wi-Fi network, etc.) for controlling presentation of information via display 51.

An operator score may have a number of useful applications in addition to providing an operator with feedback on how well they are driving a vehicle. For instance, operator scores may be used by an organization to effectively manage a vehicle fleet, objectively assess operator experience, assign operators to routes based on operator experience, reward operators for saving fuel and driving safety, and anticipate when to order vehicle parts for maintaining a vehicle fleet.

In an example, an organization may have a fleet of vehicles that each include the diagnostic system 40. Each of the diagnostic systems 40 may communicate vehicle operation data via network 128 to computing device 141. For example, the vehicle operation data may include operator scores, vehicle parameters, diagnostic messages, geo-location data (e.g., GPS data), total fuel usage (e.g., on an assigned route, over a predetermined amount of time (week)), average fuel usage rate of an operator, and any combination thereof. The vehicle operation data may also include a vehicle identifier, the user identifier, a time stamp indicating when the data was collected, and any combination thereof. Computing device 141 may process the vehicle operation data for management of the fleet and for comparing operator performance across multiple vehicles.

In an example, computing device 141 may utilize vehicle operation data on fuel consumption, geo-location data, and operator score to automatically calculate a desired route between multiple fixed locations for an operator to follow. Efficient route selection can improve an organization's finances as compared to using less efficient routes. However, efficiency can vary from day to day based on whether it would be better to maximize fuel economy or to have an operator more quickly complete a current route so that they are available to go out on a subsequent route. Computing device 141 may utilize vehicle operation data on fuel consumption, geo-location data, and operator score to automatically design a desired route for an operator to follow based on current fuel prices. In an example, refuse vehicles may be assigned to stop at a set of fixed locations. Rather than requiring all operators to follow the exact path from location to location, the operators may be permitted to follow any route of their choosing so long as the operator stops at each of the locations. Computing device 141 may collect data from one or more vehicles upon completion of each route, including geo-location data, fuel consumption, and operator score. Computing device 141 may process the data to determine a preferred path between the fixed locations that resulted in the highest operator score and lowest fuel consumption. In other instances, computing device may process the data to determine a preferred path between the fixed locations that resulted in the highest operator score and could be completed in the least amount of time, thereby making the operator available to be assigned to a subsequent route. Computing device 141 may designate the preferred path as the route to be used by future operators between the fixed locations. Computing device 141 may also adjust calculation of the operator score to award points for operators who follow the preferred path (via using geo-location data) and to reduce the operator score for those who deviate from the path. Computing device 141 may repeat this process to create preferred paths for any number of routes. For example, computer 141 may identify preferred paths for 50 different routes.

The preferred path may also be used for forecasting future fuel purchases. In an example, computing device 141 may determine how often the route is to be traversed, expected fuel price, and the average fuel consumption on the route to calculate how much fuel to order. For instance, a refuse vehicle may proceed along a particular route once a week for the next 12 weeks, may use 10 gallons of fuel each time the route is traversed, and the fuel price may be expected to average $4.00 per gallon over the next 12 weeks, thus resulting in an expected fuel cost of $480 (e.g., 12*10*4). Computing device 141 may automatically place an order for 10 gallons of fuel per week to accommodate this route. Computing device 141 may repeat this process for any number of routes to estimate how much fuel to order for an organization (e.g., 1,000 gallons per week). In response to the estimated amount of needed fuel, computing device 141 may automatically place a fuel order with a fuel distributor for delivery to a desired location at a desired time to meet the expected demand. Computing device 141 may also vary the amount of fuel ordered based on the current amount of fuel that has not yet been dispensed.

Computing device 141 may also use the preferred path to reward an operator who utilizes less fuel on the route. Continuing the above example, an operator who utilizes 100 gallons, instead of 120 gallons, during the 12 week period may save the organization $80 on that route (e.g., 20 gallons*$4.00/gallon=$80). Computing device 141 may award an incentive to the operators (e.g., a monetary fuel efficiency bonus in a subsequent paycheck) that is at least a portion of the savings (e.g., up to $80). Computing device 141 may also use an operator's ability to save fuel as an objective factor in assessing an operator expertise level and to determine when to promote the operator.

Computing device 141 may also be used to objectively assess operator experience for assigning the best operators to the most difficult routes. Computing device 141 may process the vehicle operation data to determine operator scores for each route and may aggregate the scores of each route to assess which of the routes are the most difficult. For example, computing device 141 may determine an average operator score for each route, and may identify one or more routes having the lowest average operator score as being the most difficult routes. To identify the most expert operators, computing device 141 may assess the expertise of the operators by ranking the operators based on their operator score on the most difficult routes. For example, computing device 141 may identify the operators who have the highest operator scores on the most difficult routes. Similarly, computing device 141 may identify the operators having the lowest operator scores on the most difficult routes.

In one example, computing device 141 may use the expertise ranking information to automatically generate a schedule for the operators. For instance, an organization may send operators on fifteen substantially predefined routes. Computing device 141 may rank the fifteen routes based on difficulty and may assign operators to the fifteen routes based on operator expertise and route difficulty. For example, if there are fifteen operators and each route takes approximately the same amount of time to complete, then computing device 141 may assign the operators in rank order based on difficulty (e.g., highest expertise operator to most difficult route, next highest expertise operator to next most difficult route, and so forth).

In another example, computing device 141 may estimate daily fuel consumption based on operator score. For instance, computing device 141 may correlate operator score to an average amount of fuel usage, and may predict how much fuel a current operator will use on a route. For example, computing device 141 may determine that an operator has an average score of 120 on easy routes, an average score of 90 on medium difficulty routes, and an average score of 67 on hard routes. Computing device 141 may determine that other users average 130 on easy routes, an average score of 100 on medium difficulty routes, and an average score of 81 on hard routes. Because the current operator scores worse than average, computing device 141 may determine that the current operator will use more fuel than the average operator. If, however, the current operator had scored better than average, computing device 141 may determine that the current operator will use less fuel than the average operator. When a driver is assigned to a particular route, computing device 141 may determine a difficulty level of the route (e.g., hard, medium, easy), may determine the average amount of fuel used on the route, and may estimate whether the operator will use more, less, or the average amount of fuel. Computing device 141 may use this technique to assign operators to available routes to minimize fuel usage and to estimate daily fuel consumption by the driver and optionally by a vehicle fleet.

Computing device 141 may also use the vehicle operation data to reward operators for improvements in fuel usage fuel and driving safety. In an example, each operator may receive a reward for increasing operator score by a predetermined amount within a predetermined time period (e.g., improve average operator score by fifteen points in three months). Computing device 141 may process the data to track an operator's performance over the predetermined time period to determine whether the operator has met the improvement goal. Rewards may be monetary, improved schedules, time off, or other incentives. Computing device 141 may also reward operators who consistently have an operator score above a predetermined level. For example, computing device 141 may determine an average aggregate operator score for all operators and may award any operator having an average operator score that is a predetermined amount (e.g., ten percent) higher than the average aggregate operator score.

In other examples, computing device 141 may assign operators to teams that compete with one another. For example, computing device 141 may select two or more teams of operators where each team has historically had a similar aggregate average operator score. Once the competition begins, computing device 141 may monitor vehicle operation data for each team over a predetermined amount of time (or a predetermined number of routes) to generate an average team operator score. Computing device 141 may provide periodic updates (e.g., real-time, hourly, daily, weekly, after completion of each route, etc.) to let each team know how its performance compares to the one or more other teams. At the end of the predetermined amount of time, computing device 141 may determine which team had the highest team score and award a prize to the winning team. Other teams may also receive awards, if desired.

Computing device 141 may also use the vehicle operation data to assist the organization to determine when it has met the requirements to apply for a tax credit. In many states today, refuse companies have the opportunity to apply for a tax credit based on how much fuel is spent in the PTO mode. The PTO mode may use fuel to accomplish a job for a necessary community function of picking up trash and many states provide tax credits for fuel used in this mode. Computing device 141 may receive vehicle operation data from the vehicle indicating the amount of fuel used when in the PTO mode (e.g., timed fuel usage, resettable fuel usage, and miles per gallon) for submission to apply for the tax credits. Computing device 141 may aggregate the data to estimate how much fuel has been used in the PTO mode and to estimate the amount of the tax credit. Computing device 141 may also provide an incentive to operators who properly comply with tax laws to earn the tax credits. Computing device 141 may award an incentive to the operators (e.g., a tax refund compliance bonus in a subsequent paycheck for the operator) that is at least a portion of the tax credit. Computing device 141 may also indicate the operator's expertise level based on his or her ability to comply with tax laws and to provide objective information that can be used to assess when to promote the operator.

In a further example, computing device 141 may process the vehicle operation data to predict when to order replacement parts and to estimate future vehicle maintenance costs. Computing device 141 may receive vehicle service data indicating the age of at least some vehicle components and each service that has been performed on the vehicle over its lifetime. Over time, computing device 141 may calculate an average operator score of any operator who has ever driven a particular vehicle. Computing device 141 may then correlate average operator score to vehicle maintenance costs to predict when to order replacement parts and to estimate future vehicle maintenance costs. For instance, computing device 141 may identify similar vehicles assigned to similar routes, what maintenance those vehicles required, and the associated maintenance costs. Computing device 141 may then classify the average operator score of any operator who has ever driven the vehicle as being lower than average, average, or higher than average. Computing device 141 may then determine how operator score affects vehicle maintenance costs and to identify any maintenance trends based on operator score. For example, computing device 141 may determine that vehicles having a below average operator score require more frequent brake replacement, and may keep vehicle brakes in inventory to minimize vehicle downtime. Computing device 141 may also estimate an expected part lifetime based on average operator score. For example, brakes may have an average lifetime of 50,000 miles, but may only have an average lifetime of 40,000 miles for average operator scores below a first threshold, but may have an average lifetime of 60,000 for average operator scores above a second threshold. Computing device 141 may use the average operator score to estimate when it is time to order a new part. For example, computing device 141 may determine when to order a part and automatically place an order for a part with a supplier for delivery of the part to a desired location at a desired time to meet the expected need. Computing device 141 may also determine current inventory levels prior to ordering and delay ordering if a sufficient number of a particular part are already in inventory. While the above example is given in relation to brakes, computing device 141 may correlate any vehicle part to average operator score for determining when to order that part. Computing device 141 may also reward operators who result in vehicle maintenance savings for the organization. Computing device 141 may thus assist an organization in better managing its parts inventory.

The embodiments of the operator incentive system described herein provide benefits and advantages over existing designs. For example, the operator incentive system provides increased communication of information to the operator of the vehicle, which enhances the operator's ability to operate the vehicle in the safest, most efficient, and most effective way. This is particularly useful for heavy duty vehicles, as they are exposed to more rigorous conditions as compared to other types of vehicles. The ability to select the type and amount of information displayed is also useful for commercial vehicles, as the desired information can be changed depending on the end use of the vehicle. As a further example, the diagnostic system can provide warnings, alerts, and other critical information in a form that is highly visible to the operator, such as by replacing at least a portion of the information on the display. This improves the probability that the information is noticed by the operator, who may not immediately notice that a gauge or meter is low or that a dashboard light has been activated. As another example, the information collected by the operator incentive system may provide increased ability for the owner to monitor how efficiently the vehicle is being operated, which further enhances the owner's ability to improves the probability that vehicles are being used as intended. Still other benefits and advantages are explicitly or implicitly described herein and/or recognized by those skilled in the art.

The example embodiments also provide a number of technical solutions to technical challenges. Here, there has not been any satisfactory technical solution of how to process diagnostic messages for improving vehicle operation. The example embodiments solves this technical challenge by providing a vehicle diagnostics system that can extract measured parameters for calculating an operator score.

While the specific embodiments have been illustrated and described, numerous modifications come to mind without significantly departing from the spirit of the invention, and the scope of protection is only limited by the scope of the accompanying Claims.

What is claimed is:

1. A vehicle operator incentive system, comprising:

a vehicle control system comprising a plurality of controllers, wherein the plurality of controllers is configured to communicate diagnostic messages regarding a plurality of components of a vehicle via an internal communication network; and a vehicle diagnostic system communicatively coupled to the internal communication network and configured to:

correlate at least one diagnostic message with at least one operation of the vehicle by an operator;

process the at least one correlated diagnostic message to determine at least one measured parameter in response to substantially real-time operation of the vehicle by the operator, wherein the at least one measured parameter provides information about the at least one operation of the vehicle by the operator;

award points based on the at least one measured parameters;

calculate a score for the operator based on the awarded points; and cause a user interface of the vehicle to display the score in substantially real-time.

2. The vehicle operator incentive system of claim 1, wherein the vehicle diagnostic system calculates the operator score as a mathematical function of the awarded points.

3. The vehicle operator incentive system of claim 1, wherein the awarding of points is weighted to encourage a particular behavior.

4. The vehicle operator incentive system of claim 1, wherein the vehicle diagnostic system is configured to receive an adjustment to an algorithm for awarding points and to award points in accordance with the adjusted algorithm.

5. The vehicle operator incentive system of claim 1, wherein the at least one measured parameter comprises a fuel economy parameter and an acceleration parameter.

6. The vehicle operator incentive system of claim 1, wherein the vehicle diagnostic system is configured to determine that one or more of the at least one measured parameter falls outside of an acceptable range.

7. The vehicle operator incentive system of claim 6, wherein the vehicle diagnostic system is configured to communicate an alert message in response to determining that one or more of the at least one measured parameter falls outside of the acceptable range.

8. The vehicle operator incentive system of claim 1, wherein the vehicle diagnostic system is configured to determine that the operator score does not comply with a minimum acceptable score.

9. The vehicle operator incentive system of claim 8, wherein the vehicle diagnostic system is configured to communicate an alert message in response to determining that the operator score does not comply with the minimum acceptable score.

10. The vehicle operator incentive system of claim 1, wherein the vehicle diagnostic system is configured to prompt an operator whether to continue running a performance analysis.

11. The vehicle operator incentive system of claim 1, wherein the vehicle diagnostic system is configured to cause the user interface to display a leaderboard and current information of the operator.

12. The vehicle operator incentive system of claim 11, wherein the leaderboard comprises a ranked listing of operators and corresponding operator scores.

13. The vehicle operator incentive system of claim 11, wherein the leaderboard comprises a corresponding number of milestones accomplished.

14. The vehicle operator incentive system of claim 1, wherein the vehicle diagnostic system is configured to determine that the operator has achieved a milestone.

15. The vehicle operator incentive system of claim 14, wherein the vehicle diagnostic system is configured to provide an award display, an accomplishment alert, or an audible cue to inform the operator that the milestone has been achieved.

16. The vehicle operator incentive system of claim 15, wherein the award display provides a textual description of the milestone achieved.

17. The vehicle operator incentive system of claim 1, wherein the vehicle diagnostics system is configured to cause a transmitter to transmit the operator score via a network.

18. A vehicle operator incentive computerized system comprising:

a vehicle control system comprising a plurality of controllers, wherein the plurality of controllers is configured to communicate diagnostic messages regarding a plurality of components of a vehicle via an internal communication network; and a vehicle diagnostic system comprising a processor communicatively coupled to the internal communication network and configured to execute computer executable instructions to:

identify a type of the vehicle;

correlate at least one diagnostic message with at least one operation of the vehicle by an operator;

process the at least one correlated diagnostic message to determine at least one measured parameter in response to substantially real-time operation of the vehicle by the operator, wherein the at least one measured parameter provides information about the at least one operation of the vehicle by the operator;

award points based on the at least one of measured parameter;

calculate an operator score for the operator based on the awarded points; and cause a user interface of the vehicle to display the operator score in substantially real-time.

19. The vehicle operator incentive computerized system of claim 18, wherein:

the at least one measured parameter comprises one or more first measured parameters and one or more second measured parameters; and the processor is further configured to execute computer executable instructions to apply at least one weighted value to the one or more first measured parameters relative to one or more second measured parameters in response to the identified type of the vehicle before awarding points based on the at least one measured parameter.

20. A vehicle operator incentive system comprising:

a vehicle control system comprising a plurality of controllers, wherein the plurality of controllers is configured to communicate diagnostic messages regarding a plurality of components of a vehicle via an internal communication network; and a vehicle diagnostic system communicatively coupled to the internal communication network and configured to:

correlate at least one first diagnostic message with at least one first operation of the vehicle by an operator;

process the correlated at least one first diagnostic message to determine at least one first measured parameter in response to substantially real-time operation of the vehicle by the operator, wherein the at least one first measured parameter provides information about the at least one first operation of the vehicle by an operator;

award points based on the at least one measured parameter;

calculate a first score for the operator based on the awarded points;

cause a user interface of the vehicle to display the first score and corresponding first information of the at least one measured parameter in substantially real-time;

correlate at least one second diagnostic message with at least one second operation of the vehicle by the operator;

process the correlated at least one second diagnostic message to determine at least one second measured parameter in response to substantially real-time operation of the vehicle by the operator, wherein the at least one second measured parameter provides information about the at least one second operation of the vehicle by the operator;

award remaining points based on the at least one second measured parameters;

calculate remaining scores for the operator based on the awarded remaining points; and cause the user interface of the vehicle to display a summary of the first score, the corresponding first information, the remaining scores, and information corresponding to the remaining scores in substantially real-time.

* * * * *